US009508305B2

(12) United States Patent
Uemura et al.

(10) Patent No.: US 9,508,305 B2
(45) Date of Patent: Nov. 29, 2016

(54) DISPLAY PANEL DRIVING DEVICE AND DISPLAY DEVICE

(71) Applicant: Sharp Kabushiki Kaisha, Osaka-shi, Osaka (JP)

(72) Inventors: Kentaroh Uemura, Osaka (JP); Masaaki Nishio, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 34 days.

(21) Appl. No.: 14/427,056

(22) PCT Filed: Sep. 13, 2013

(86) PCT No.: PCT/JP2013/074907

§ 371 (c)(1),
(2) Date: Mar. 10, 2015

(87) PCT Pub. No.: WO2014/046060

PCT Pub. Date: Mar. 27, 2014

(65) Prior Publication Data

US 2015/0243239 A1 Aug. 27, 2015

(30) Foreign Application Priority Data

Sep. 19, 2012 (JP) ..... 2012-205458

(51) Int. Cl.
*G09G 5/00* (2006.01)
*G09G 3/36* (2006.01)

(52) U.S. Cl.
CPC ..... *G09G 3/3696* (2013.01); *G09G 3/3614* (2013.01); *G09G 3/3688* (2013.01); *G09G2310/0291* (2013.01); *G09G 2310/06* (2013.01); *G09G 2310/08* (2013.01); *G09G 2320/02* (2013.01); *G09G 2330/025* (2013.01)

(58) Field of Classification Search
CPC .... G09G 3/36; G09G 3/3614; G09G 3/3688; G09G 3/3696; G09G 2310/06; G09G 2310/08; G09G 2310/0291; G09G 2320/02; G09G 2330/025
USPC ..... 345/87–100, 204–215, 690
See application file for complete search history.

(56) References Cited

U.S. PATENT DOCUMENTS 7,683,873 B2 * 3/2010 Okamura ..... G09G 3/3688 345/100
7,710,373 B2 * 5/2010 Nose ..... G09G 3/2092 345/204
2005/0264548 A1 12/2005 Okamura et al.
2006/0227092 A1 10/2006 Nose

FOREIGN PATENT DOCUMENTS

JP 2003-233358 A 8/2003
JP 2005-338421 A 12/2005
JP 2006-292899 A 10/2006

OTHER PUBLICATIONS

Official Communication issued in International Patent Application No. PCT/JP2013/074907, mailed on Dec. 17, 2013.

* cited by examiner

*Primary Examiner* — Vijay Shankar
(74) *Attorney, Agent, or Firm* — Keating & Bennett, LLP

(57) ABSTRACT

A display device is provided that effectively reduces noise generated inside a display panel such as a liquid crystal panel. The source driving unit of the display device includes positive amplifiers, negative amplifiers, a positive amplifier regulating unit and a negative amplifier regulating unit. The positive amplifiers transmit positive driving signals to the display panel unit via source lines. The negative amplifiers transmit negative driving signals to the display panel via source lines. The positive amplifier regulating unit regulates the timing for the positive amplifiers to output positive driving signals. The negative amplifier regulating unit regulates the timing for the negative amplifiers to output negative driving signals.

14 Claims, 6 Drawing Sheets

DISPLAY PANEL DRIVING DEVICE AND DISPLAY DEVICE

TECHNICAL FIELD

The present invention relates to a technique of driving a display panel such as a liquid crystal panel.

BACKGROUND ART

A liquid crystal panel includes a plurality of source lines and a plurality of gate lines, and a pixel is provided at the intersection of a source line and a gate line. Based on image signals (display data), the liquid crystal panel drives the source lines using a source driver, and drives the gate lines using a gate driver, thereby displaying an image on the liquid crystal panel. The liquid crystal panel is commonly driven by an alternating voltage because driving the liquid crystal panel using a direct voltage would lead to decreased lifetime of the liquid crystal panel. Methods for driving a liquid crystal panel using an alternating voltage include, for example, dot inversion driving, where each pixel is switched between positive and negative driving voltages, column inversion driving, where each column is switched between positive and negative driving voltages, and line inversion driving, where each row is switched between positive and negative driving voltages.

Various noises occur when the source and gate drivers are driven to display an image on the liquid crystal panel. To reduce such noises, various techniques are used.

For example, the technique disclosed in Patent Document 1 prevents a large amount of current from flowing by preventing the current for driving the liquid crystal panel from concentrating, thereby reducing noise when the liquid crystal panel is driven. More specifically, the technique of Patent Document 1 provides an amplifier circuit including a multi-output amplifier circuit having multiple output terminals and a delay circuit causing the source lines to be driven at dispersed timings. The multi-output amplifier circuit is composed of a plurality of amplifier blocks. The delay circuit causes the amplifier blocks to operate at different timings by delaying line output signals. This prevents current for driving the liquid crystal panel from being concentrated, thereby effectively preventing large current from flowing. Thus, the technique of Patent Document 1 reduces noise generated when the liquid crystal panel is driven.

CONVENTIONAL ART DOCUMENTS

Patent Documents

Patent Document 1: JP 2003-233358 A

SUMMARY OF THE INVENTION

Problems to be Solved by the Invention

The technique of Patent Document 1 prevents momentary large current flowing through the drivers which drive the liquid crystal panel (the source and gate drivers). However, the arrangement disclosed in Patent Document 1 addresses momentary current occurring inside the drivers, meaning that effectively reducing noise generated inside the liquid crystal panel is still difficult.

Noise is generated inside a liquid crystal panel when the liquid crystal panel is to display an image (display data), when the panel is scanned. In the case of a capacitive touch panel-equipped display device, for example, such noise may affect the sensor sensitivity of the touch panel, causing a malfunction.

In view of the above problems, an object of the present invention is to provide a display panel driving device and display device that effectively reduce noise generated inside a display panel such as a liquid crystal panel.

Means to Solve the Problems

To solve the above problems, a display panel driving device of a first aspect is a display panel driving device for driving a display panel including a plurality of source lines and a plurality of gate lines and pixels each provided at the intersection of a source line and a gate line, including positive amplifiers, negative amplifiers, a positive amplifier regulating unit, a negative amplifier regulating unit, and a gate driving unit.

The positive amplifiers each transmit a positive driving signal to the display panel via a source line.

The negative amplifiers each transmit a negative driving signal to the display panel via a source line.

The positive amplifier regulating unit regulates timing for the positive amplifiers to output the positive driving signals.

The negative amplifier regulating unit regulates timing for the negative amplifiers to output the negative driving signals.

The gate driving unit drives and controls the display panel by supplying the display panel with gate line control signals via the gate lines.

Effects of the Invention

The present invention provides a display panel driving device and display device that effectively reduce noise generated inside a display panel such as a liquid crystal panel.

EMBODIMENTS FOR CARRYING OUT THE INVENTION

First Embodiment

The first embodiment will be described below with reference to the drawings.

<1.1: Construction of Display Device>

Figure 1:
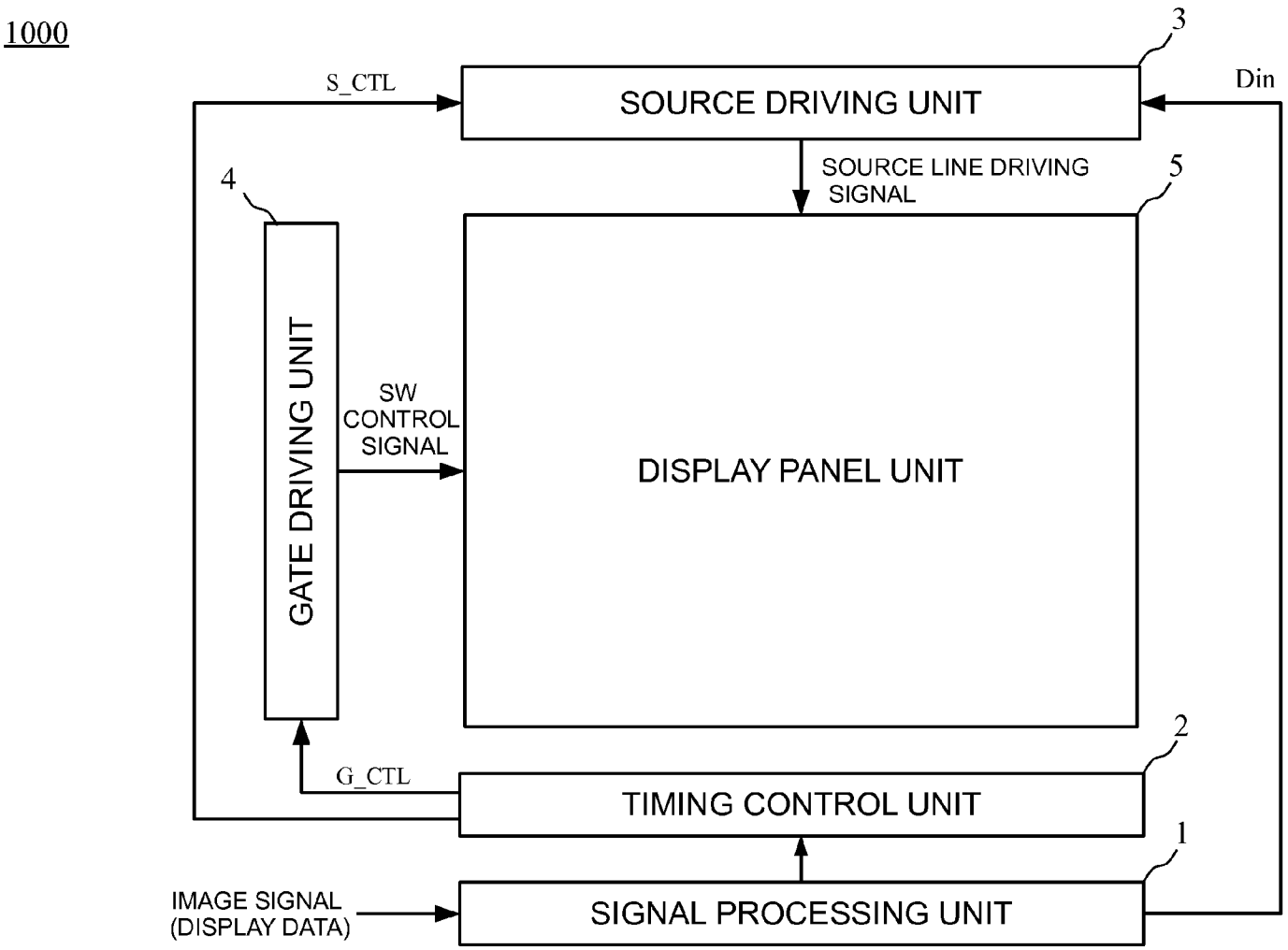
FIG. 1 is a schematic diagram of a display device 1000 of a first embodiment.

FIG. 1 is a schematic diagram of a display device 1000 according to a first embodiment.

As shown in FIG. 1, the display device 1000 includes a signal processing unit 1 for acquiring synchronization signals (a horizontal synchronization signal, vertical synchronization signal and the like) from a received image signal (display data) and outputting the image signal (display data) in the form of data in a predetermined format (display data Din). The display device 1000 further includes a timing control unit 2 which, based on the synchronization signals acquired by the signal processing unit 1, generates a gate control signal G_CTL for controlling a gate driving unit 4 and a source control signal S_CTL for controlling a source driving unit 3. The display device 1000 further includes the source driving unit 3 which, based on the source control signal S_CTL, generates source line driving signals for driving the display panel unit 5 so as to display an image based on the display data Din, and the gate driving unit 4 which, based on the gate control signal G_CTL, generates SW control signals for driving the display panel unit 5. The display device 1000 further includes the display panel unit 5 which is driven and controlled by the source driving unit 3 and gate driving unit 4 to display an image formed by the image signal (display data Din).

The signal processing unit 1 receives an image signal (display data) and acquires synchronization signals (a horizontal synchronization signal, vertical synchronization signal and the like) from the received image signal (display data) and transmits the acquired synchronization signals to the timing control unit 2. Further, the signal processing unit 1 converts the received image signal (display data) to data in a predetermined format and transmits it to the source driving unit 3. For example, when the received image signal is an image signal in YCbCr color space and the display panel unit 5 displays an image using RGB subpixels, the signal processing unit 1 converts an image signal in YCbCr color space to an image signal in RGB color space. In other words, the signal processing unit 1 converts the received image signal to a data format (signal format) that allows an image to be displayed on the display panel unit 5 when the source driving unit 3 drives and controls the source lines of the display panel unit 5, and transmits the converted data (signal) to the source driving unit 3. This conversion process is not necessary if the image signal received by the signal processing unit 1 is in a data format (signal format) that allows an image to be displayed on the display panel unit 5 when the source driving unit 3 drives and controls the source lines of the display panel unit 5.

The timing control unit 2 receives the synchronization signals acquired by the signal processing unit 1 and, based on the received synchronization signals, generates a gate control signal G_CTL to be used by the gate driving unit 4 to drive and control the display panel unit 5 and a source controller signal S_CTL to be used by the source driving unit 3 to drive and control the display panel unit 5. The timing control unit 2 then transmits the generated gate control signal G_CTL to the gate driving unit 4 and transmits the generated source control signal S_CTL to the source driving unit 3.

The source driving unit 3 receives the display data Din transmitted from the signal processing unit 1 and the source control signal S_CTL transmitted from the timing control unit 2. Based on the display data Din and the source control signal S_CTL, the source driving unit 3 generates source line driving signals for driving source lines of the display panel unit 5 and transmits the generated source line driving signals to the display panel unit 5.

Figure 2:
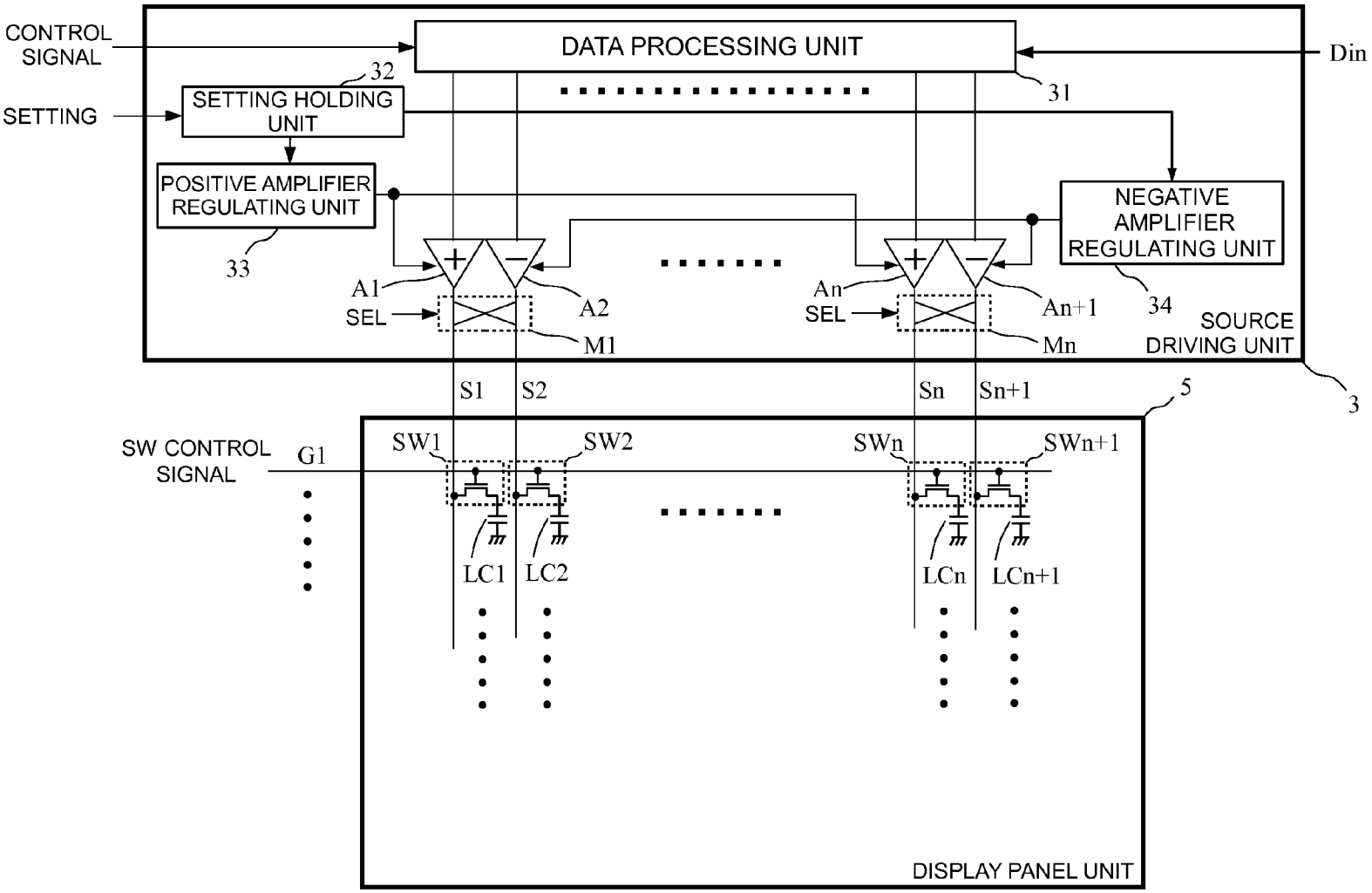
FIG. 2 is a schematic diagram of the source driving unit 3 and display panel unit 5 of the first embodiment.

The source driving unit 3 will now be described in detail below with reference to FIG. 2. FIG. 2 schematically shows the source driving unit 3 and parts of the display panel unit 5.

As shown in FIG. 2, the source driving unit 3 includes a data processing unit 31, a setting holding unit 32, a positive amplifier regulating unit 33, and a negative amplifier regulating unit 34. The source driving unit 3 further includes positive amplifiers A1, A3, A5, . . . , and An, negative amplifiers A2, A4, A6, . . . , and An+1, and output line switches M1, M3, M5, . . . , and Mn.

As shown in FIG. 2, the data processing unit 31 receives the display data Din transmitted from the signal processing unit 1 and a control signal contained in the source control signal S_CTL transmitted from the timing control unit 2. Further, the data processing unit 31 includes n+1 (n is a natural odd number) output lines, each connected with the corresponding one of the positive amplifiers A1, A3, A5, . . . , and An or the negative amplifiers A2, A4, A6, . . . , and An+1. In accordance with the timing determined by the control signal, the data processing unit 31 successively transmits the display data Din to the n+1 (n is a natural odd number) output lines.

The setting holding unit 32 receives settings contained in the source control signal S_CTL transmitted from the timing control unit 2. The settings include information relating to the output timing (output delay time) and/or output capability (driving capability) of the positive amplifiers A1, A3, A5, . . . , and An regulated by the positive amplifier regulating unit 33, and information relating to the output timing (output delay time) and/or output capability (driving capability) of the negative amplifiers A2, A4, A6, . . . , and An+1 regulated by the negative amplifier regulating unit 34. Alternatively, settings may be communicated by the timing control unit 2 using a command or the like and received by the setting holding unit 32. Alternatively, settings may be stored in the setting holding unit 32 in advance and held by the same. For example, during manufacture of a display device 1000, settings may be stored in the setting holding unit 32 in advance and let it hold them, where they cannot be altered externally. In this case, input from the timing control unit 2 to the setting holding unit 32 is eliminated.

The setting holding unit 32 transmits settings for regulating positive amplifiers to the positive amplifier regulating unit 33, and transmits settings for regulating negative amplifiers to the negative amplifier regulating unit 34.

Based on the settings for regulating positive amplifiers, the positive amplifier regulating unit 33 regulates the output timing (output delay time) and/or output capability (driving capability) for the positive amplifiers A1, A3, A5, . . . , and An. The settings for regulating positive amplifiers are held in the setting holding unit 32 and transmitted from the setting holding unit 32 to the positive amplifier regulating unit 33.

Based on the settings for regulating negative amplifiers, the negative amplifier regulating unit 34 regulates the output timing (output delay time) and/or output capability (driving capability) for the negative amplifiers A2, A4, A6, . . . , and An+1. The settings for regulating negative amplifiers are held in the setting holding unit 32 and transmitted from the setting holding unit 32 to the negative amplifier regulating unit 34.

The positive amplifiers A1, A3, A5, . . . , and An each receive signals from the data processing unit 31. Based on the output timing (output delay time) and output capability (driving capability) which are decided by the positive amplifier regulating unit 33 depending on the settings, the positive amplifiers A1, A3, A5, . . . , and An transmit the received signals to the output line switches M1, M3, M5, . . . , and Mn, respectively. The output capability (driving capability) of the positive amplifiers A1, A3, A5, . . . , and An may be regulated by regulating the output resistance of the positive amplifiers A1, A3, A5, . . . , and An, for example.

The negative amplifiers A2, A4, A6, . . . , and An+1 receive signals transmitted from the data processing unit 31. Based on the output timing (output delay time) and output capability (driving capability) which are decided by the negative amplifier regulating unit 34 depending on the settings, the negative amplifiers A2, A4, A6, . . . , and An+1 transmit the received signals to the output line switches M1, M3, M5, . . . , and Mn, respectively. The output capability (driving capability) of the negative amplifiers A2, A4, A6, . . . , and An+1 may be regulated by regulating the output resistance of the negative amplifiers A2, A4, A6, . . . , and An+1, for example.

The output line switches M1, M3, M5, . . . , and Mn each receive the output of the positive and negative amplifiers. Based on a switch signal SEL, each of the output line switches between the destinations of the output signals of a pair of amplifiers, a positive amplifier and a negative amplifier. More specifically, the output line switch Mk (k is a natural odd number, $1 \leq k \leq n$) switches between the destinations of the output signals of its positive and negative amplifiers such that:

(1) the output of the positive amplifier Ak is transmitted to the source line Sk and the output of the negative amplifier Ak+1 is transmitted to the source line Sk+1 (which may be referred to as straight output); or (2) the output of the positive amplifier Ak is transmitted to the source line Sk+1 and the output of the negative amplifier Ak+1 is transmitted to the source line Sk (which may be referred to as cross output).

The reason why the output line switches M1, M3, M5, . . . , and Mn switch between the destinations of output signals in the above-described manner is to drive the display panel unit 5 by switching between the positive and negative driving voltages in accordance with the column inversion driving or dot inversion driving. Thus, the switch signal SEL is set based on the driving method for the display panel unit 5.

A switch signal SEL may be contained in the source control signal S_CTL transmitted from the timing control unit 2, or may be generated by the source driving unit 3 from a control signal or the like.

As described above, the source driving unit 3 supplies the display panel unit 5, through the output line switches M1, M3, M5, . . . , and Mn, with source line driving signals for driving the source lines S1 to Sn+1 of the display panel unit 5.

The gate driving unit 4 receives the gate control signal G_CTL transmitted from the timing control unit 2. The gate driving unit 4 is connected with the display panel unit 5 through a plurality of gate lines. Based on the gate control signal G_CTL, the gate driving unit 4 generates, for each gate line, a SW control signal for driving the display panel unit 5, and transmits the generated SW control signals to the display panel unit 5 through the respective gate lines.

As shown in FIGS. 1 and 2, the display panel unit 5 receives source line driving signals transmitted from the source driving unit 3 and SW control signals transmitted from the gate driving unit 4. As shown in FIG. 2, the display panel unit 5 includes pixels, each of which is located at the intersection of a gate line and a source line and includes a display element (for example, a liquid crystal element) and a switch element. For example, as shown in FIG. 2, a switch element SW1 is located at the intersection of the gate line G1 and source line S1. The switch element SW1 may be a thin-film transistor (TFT) element, for example.

The following description presupposes that the switch elements are thin-film transistor (TFT) elements and the display elements are liquid crystal elements.

As shown in FIG. 2, in the pixel located at the intersection of the gate line G1 and source line S1, the gate of the switch element SW1 is connected with the gate line G1, the source of the switch element SW1 is connected with the source line S1, and the drain of the switch element SW1 is connected with the liquid element LC1. The pixels located at the intersections of the gate line G1 and the source lines S2, . . . , Sn, Sn+1 have the same construction.

In the display panel unit 5, transmitting an SW control signal for turning on the switch elements SW1 to SWn+1 through the gate line G1 from the gate driving unit 4 causes the switch elements SW1 to SWn+1 to become conductive (turns on), and the liquid crystal elements LC1 to LCn+1 are controlled by signals transmitted from the source driving unit 3 through the source lines S1 to Sn+1. The other gate lines are controlled in the same manner. Through the above processing, the display panel unit 5 displays an image corresponding to the display data Din.

The "display panel driving device" is constituted by the source driving unit 3 and gate driving unit 4.

<1.2: Operation of Display Device>

The operation of a display device 1000 constructed as discussed above will be described below.

The signal processing unit 1 acquires synchronization signals (a horizontal synchronization signal, vertical synchronization signal and the like) from a received image signal (display data), and transmits the acquired synchronization signals to the timing control unit 2. The signal processing unit 1 converts the received image signal (display data) to a signal Din (display data Din) in a data format that allows an image corresponding to the image signal (display data) to be displayed on the display panel unit 5 when the source driving unit 3 drives the display panel unit 5, and the resulting signal Din (display data Din) is transmitted to the source driving unit 3. This signal conversion step of the signal processing unit 1 is not necessary if the received image signal is in a signal format (data format) in which the source driving unit 3 drives the display panel unit 5.

The timing control unit 2 generates, from the synchronization signals acquired by the signal processing unit 1, the source control signal S_CTL for driving and controlling the display panel unit 5 and transmits the generated source control signal S_CTL to the source driving unit 3. Further, the timing control unit 2 generates, from the synchronization signals acquired by the signal processing unit 1, the gate control signal G_CTL for driving and controlling the display panel unit 5 and transmits the generated gate control signal G_CTL to the gate driving unit 4.

The gate driving unit 4 generates, from the gate control signal C_CTL, SW control signals for driving the gate lines connected with the display panel unit 5. The SW control signals control the switch elements of the pixels of the display panel unit 5 connected with the gate lines to turn on or off.

The data processing unit 31 of the source driving unit 3 receives the display data Din transmitted from the signal processing unit 1. The data processing unit 31 subjects the display data Din to a delaying process (processing by the shift registers), gain adjustment process, DA conversion process and other processing, and transmits the resulting data to the positive amplifiers A1, A3, . . . , and An and negative amplifiers A2, A4, . . . , An+1 in accordance with the timing determined by the control signal contained in the source control signal S_CTL transmitted from the timing control unit 2.

The output regulation for the positive amplifiers A1, A3, . . . , and An and negative amplifiers A2, A4, . . . , and An+1 will be described below with reference to FIGS. 3 and 4.

Figure 3:
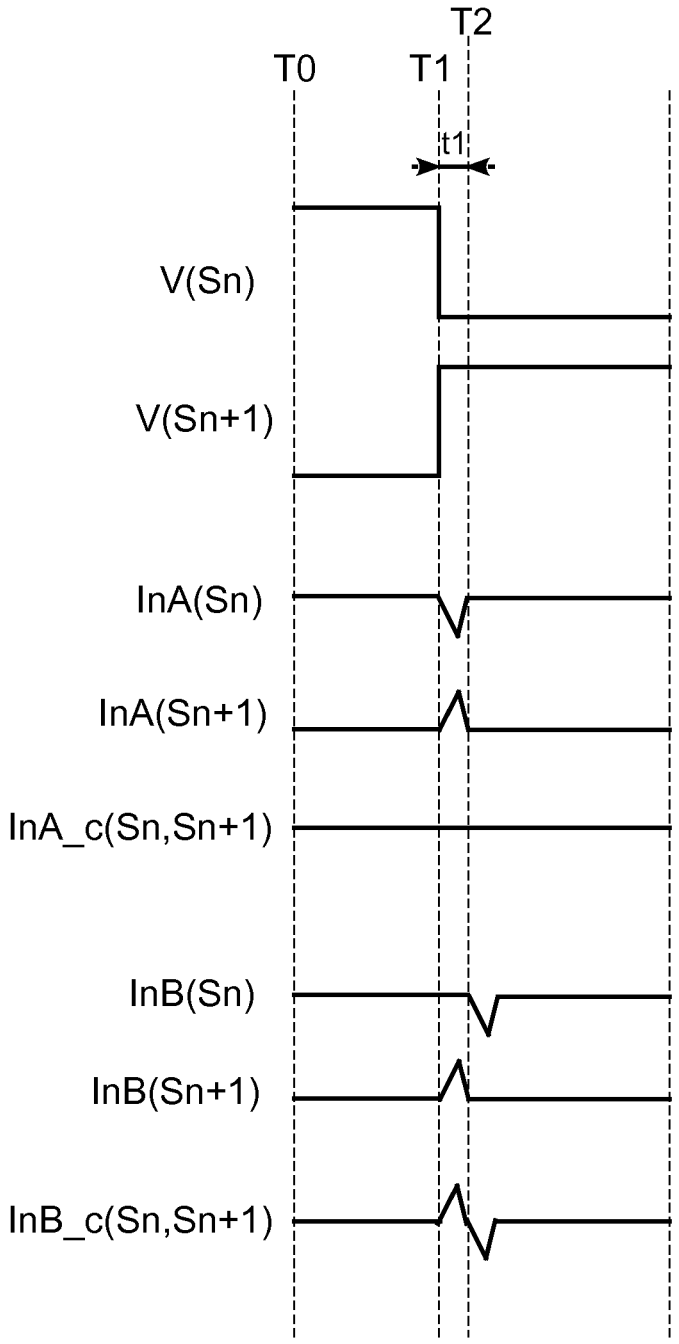
FIG. 3 schematically illustrates examples of signal waveforms and noise component waveforms in states before and after currents pass through the switch elements of the pixels of the display panel unit 5.

FIG. 3 illustrates examples of signal waveforms and noise component waveforms in states before and after currents pass through the switch elements of the pixels of the display panel unit 5. FIG. 3 shows the signal waveforms and noise component waveforms of the following (1) to (8), where their time axes (horizontal axes) are aligned:

(1) the output voltage V (Sn) of the positive amplifier An in a state before a current passes through the switch element SWn (the voltage V(Sn) on the source line Sn);

(2) the output voltage V(Sn+1) of the negative amplifier An+1 in a state before a current passes through the switch element SWn+1 (the voltage V(Sn+1) on the source line Sn+1);

(3) the noise component (noise current) InA (Sn) on the source line Sn in a state before a current passes through the switch element SWn;

(4) the noise component (noise current) InA (Sn+1) on the source line Sn+1 in a state before a current passes through the source element SWn+1;

(5) the combined noise component (combined noise current) InA_c (Sn, Sn+1) from the noise component on the source line Sn in a state before a current passes through the switch element SWn and the noise component on the source line Sn+1 in a state before a current passes through the switch element SWn+1;

(6) the noise component (noise current) InB(Sn) on the source line Sn in a state after a current has passed through the switch element SWn;

(7) the noise component (noise current) InB(Sn+1) on the source line Sn+1 in a state after a current has passed through the switch element SWn+1; and (8) the combined noise component (combined noise current) InB_c(Sn, Sn+1) from the noise component on the source line Sn in a stateafter a current has passed through the switch element SWn and the noise component on the source line Sn+1 in a state after a current has passed through the switch element SWn+1.

If the voltage V(Sn) on the source line Sn transitions from high voltage to low voltage at the same time point as the voltage V (Sn+1) on the source line Sn+1 transitions from high voltage to low voltage, the noise current components generated by fluctuations in voltage are offset. As shown in FIG. 3, before currents pass through the switch elements, the noise component (noise current) InA(Sn) generated when the voltage V (Sn) on the source line Sn transitions from high voltage to low voltage occurs generally at the same time point when the noise component (noise current) InA (Sn+1) generated as the voltage V(Sn+1) on the source line Sn+1 transitions from low voltage to high voltage (in the time period T1 to T2 of FIG. 3). Thus, these components are offset, so that the combined noise component (combined noise current) InA_c(Sn, Sn+1) has no noise component.

In contrast, after currents have passed through the switch elements, as indicated by InB(Sn), InB(Sn+1) and InB_c(Sn, Sn+1) of FIG. 3, the noise component InB(Sn) superimposed on a current flowing in the source line Sn and the noise component superimposed on the current InB(Sn+1) flowing in the source line Sn+1 are not offset, so that noise occurs in the combined noise component (combined noise current) InB_c(Sn, Sn+1). This is because the current flowing in the source line Sn, after passing through the switch SWn, is delayed with respect to a current flowing in the source line Sn+1 that has passed through the switch element SWn+1. The timing for the switch elements to turn on varies depending on the source potential. The output of the positive amplifier An, the signal (V(Sn)) on the source line Sn, has a higher potential than the output of the negative amplifier An+1 (V(Sn+1)). Thus, as shown in FIG. 3, a current flowing in the source line Sn that has passed through the switch element SWn is delayed with respect to a current flowing in the source line Sn+1 that has passed through the switch element SWn+1 by a time period of t1. As a result, after currents have passed through the switch elements, the noise component InB(Sn) superimposed on the current flowing in the source line Sn and the noise component InB(Sn+1) superimposed on the current flowing in the source line Sn+1 are not offset, so that noise occurs. This noise occurs after currents have passed through the switch elements; that is, it occurs inside the display panel unit 5 (is generated by currents flowing in source lines inside the display panel unit 5), affecting the sensor sensitivity of the capacitive touch panel placed on the display panel unit 5, for example, causing a malfunction while the touch panel is operated.

In view of this, the source driving unit 3 uses the positive and negative amplifier regulating units 33 and 34 to regulate the output timing for the positive amplifiers and the output timing for the negative amplifiers. This will be described with reference to FIG. 4.

Figure 4:
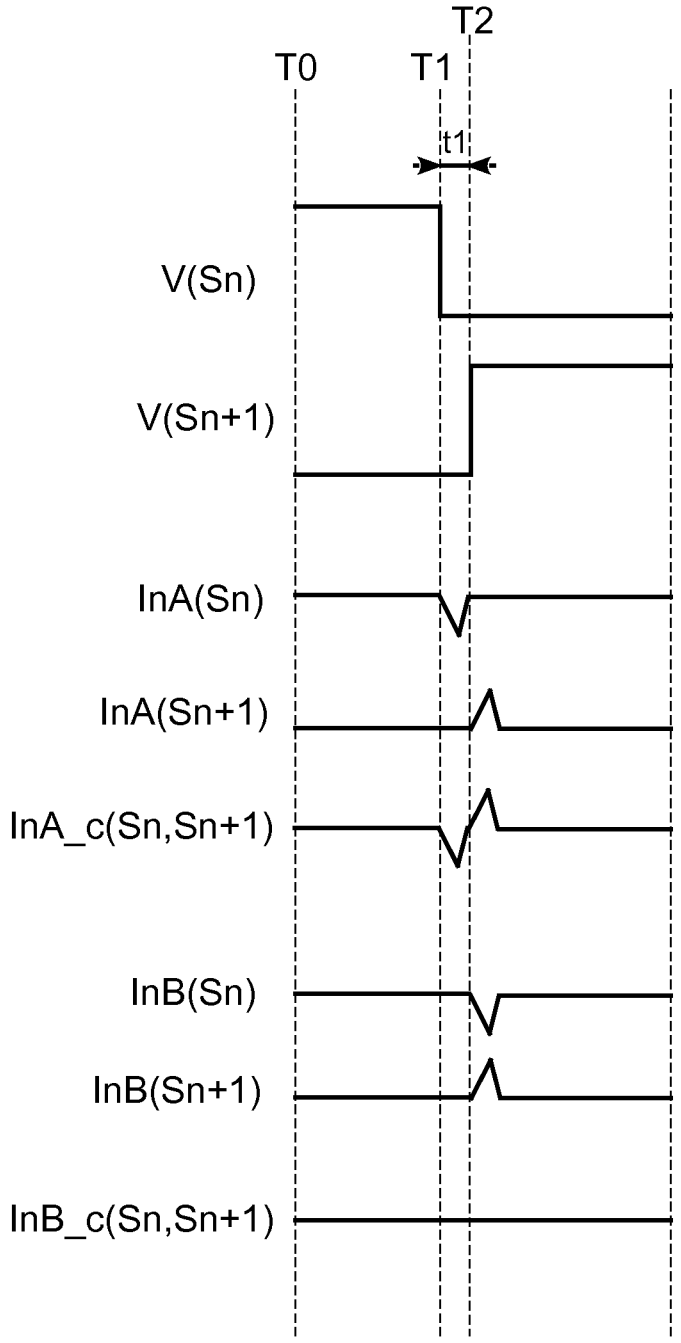
FIG. 4 schematically illustrates signal waveforms and noise component waveforms in states when the positive and negative amplifier regulating units 33 and 34 regulate the output timing of the positive amplifiers and the output timing of the negative amplifiers.

FIG. 4 illustrates examples of signal waveforms and noise component waveforms in a state when the positive and negative amplifier regulating units 33 and 34 regulate the output timing of the positive amplifiers and the output timing of the negative amplifiers. Similar to FIG. 3, FIG. 4 shows the signal waveforms and noise component waveforms of the following (1) to (8), where their time axes (horizontal axes) are aligned:

(1) the output voltage V (Sn) of the positive amplifier An in a state before a current passes through the switch element SWn (the voltage V(Sn) on the source line Sn);

(2) the output voltage V(Sn+1) of the negative amplifier An+1 in a state before a current passes through the switch element SWn+1 (the voltage V(Sn+1) on the source line Sn+1);

(3) the noise component (noise current) InA (Sn) on the source line Sn in a state before a current passes through the switch element SWn;

(4) the noise component (noise current) InA (Sn+1) on the source line Sn+1 in a state before a current passes through the source element SWn+1;

(5) the combined noise component (combined noise current) InA_c (Sn, Sn+1) from the noise component on the source line Sn in a state before a current passes through the switch element SWn and the noise component on the source line Sn+1 in a state before a current passes through the switch element SWn+1;

(6) the noise component (noise current) InB(Sn) on the source line Sn in a state after a current has passed through the switch element SWn;

(7) the noise component (noise current) InB(Sn+1) on the source line Sn+1 in a state after a current has passed through the switch element SWn+1; and (8) the combined noise component (combined noise current) InB_c(Sn, Sn+1) from the noise component on the source line Sn after a current has passed through the switch element SWn and the noise component on the source line Sn+1 in a state after a current has passed through the switch element SWn+1.

The setting holding unit 32 stores and holds information relating to the delay time t1 of the output signals of the positive amplifiers with respect to the output signals of the negative amplifiers produced when the signals pass through the switch elements. This information relating to the delay time t1, which is known in advance, is stored in the setting holding unit 32 in advance. Alternatively, the information relating to the delay time t1 may be set depending on as a setting contained in the source control signal S_CTL which is transmitted from the timing control unit 2 to the source driving unit 3. Alternatively, the information relating to the delay time t1 may be set by the signal processing unit 1.

The positive and negative amplifier regulating units 33 and 34 regulate the delay time for output signals based on the setting for regulating positive amplifiers and the setting for regulating negative amplifiers transmitted from the setting holding unit 32. More specifically, as shown in FIG. 4, the positive and negative amplifier regulating units 33 and 34 regulate the output timing such that the output signal (output voltage) V(Sn) of a negative amplifier is output with a delay of the delay time t1 with respect to the output signal (output voltage) V(Sn+1) of a positive amplifier.

Regulating the output timing in this manner causes a current flowing in the source line Sn to be delayed by the time t1 with respect to a current flowing in the source line Sn+1 when the current passes through the switch element SWn. Thus, as shown in FIG. 4, after currents have passed through the switch elements, there is no delay time of the noise component superimposed on the current flowing in the source line Sn (the noise component occurring when the potential of V(Sn) falls) with respect to the noise component superimposed on the current flowing in the source line Sn+1 (the noise component occurring when the potential of V(Sn+1) rises (there is no phase difference). As a result, as shown in FIG. 4, after currents have passed through the switch elements, the noise component InB(Sn) superimposed on the current flowing in the source line Sn and the noise component InB(Sn+1) superimposed on the current flowing in the source line Sn+1 are offset, so that no noise occurs (the combined noise component InB_c(Sn, Sn+1) of FIG. 4 has no noise). Thus, for example, noise that may affect the sensor sensitivity of a capacitive touch panel placed on a display panel unit 5 and cause a malfunction while the touch panel is operated is effectively prevented from occurring in the display panel unit 5.

As described above, in the display device 1000, the output timing (output delay amount) of the output signals (output voltages) of the positive amplifiers and the output signals (output voltages) of the negative amplifiers of the source driving unit 3 are regulated such that there is no delay (there is no phase difference) of the output signals (output currents) of the positive amplifiers with respect to the output signals (output currents) of the negative amplifiers of the source driving unit 3 after the currents have passed through the switch elements of the pixels of the display panel unit 5. Thus, in the display device 1000, after currents have passed through the switch elements of the pixels of the display panel unit 5, the noise component superimposed on the output current of each of the positive amplifiers and the noise component superimposed on the output current of the associated one of the negative amplifiers are offset. As a result, in the display device 1000, noise that may affect the sensor sensitivity of a capacitive touch panel or the like and cause a malfunction is effectively prevented from occurring inside the display panel unit 5.

Second Embodiment

A second embodiment will now be described.

In the present embodiment, the components similar to the corresponding ones of the previous embodiment are designated by the same reference characters and will not be described in detail.

A display device according to the second embodiment has a construction similar to that of the display device 1000 of the first embodiment. The display device of the second embodiment is only different from the display device 1000 of the first embodiment in terms of the processing by the source driving unit 3. In the display device 1000 of the first embodiment, the source driving unit 3 uses the positive and negative amplifier regulating units 33 and 34 to regulate the output timing of the positive amplifiers and that of the negative amplifiers, the output delay time (regulate the delay time (phase difference) of the output signals of the positive amplifiers with respect to the output signals of the negative amplifiers). Conversely, in the display device of the present embodiment, the source driving unit 3 (1) regulates the output timing of the positive amplifiers and that of the negative amplifiers in a manner similar to that of the first embodiment, and, in addition, (2) regulates the output capability (driving capability) of the positive amplifiers and that of the negative amplifiers. In terms of this point, the display device of the present embodiment is different from the display device 1000 of the first embodiment. The other structure of the display device of the present embodiment is the same as that of the display device 1000 of the first embodiment.

The above difference will be mainly described below.

In the display panel unit 5, each of the switch elements (SW1 to SWn+1) provided at the intersection of a gate line and a source line has a switch resistance (a resistance in a state when the elements are on) that varies depending on the source potential. When the driving capability (current driving capability) of the source driving unit 3 is changed, the noise waveform (signal waveform) varies depending on the driving capability (current driving capability) of the source driving unit 3, the source potential of the switch element and the switch resistance of the switch element. When the driving capability (current driving capability) of the source driving unit 3 is high, the noise component has a high peak and a short duration. In contrast, when the driver capability (current driving capability) of the source driving unit 3 is low, the noise component has a low peak and a long duration.

Figure 5:
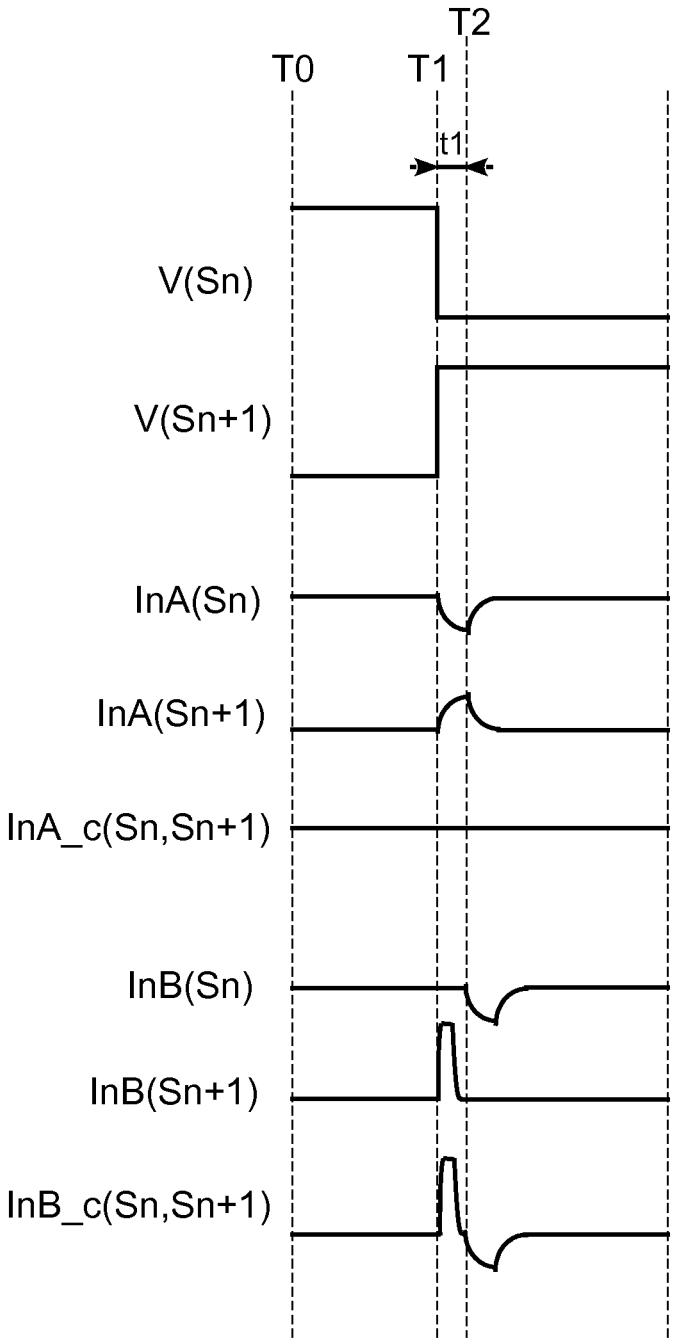
FIG. 5 schematically illustrates examples of signal waveforms and noise component waveforms in states before and after currents pass through the switch elements of the pixels of the display panel unit 5 when the driving capability (current driving capability) of the source driving unit 3 is low.

FIG. 5 illustrates examples of signal waveforms and noise component waveforms encountered before and after currents pass through the switch elements of the pixels of the display panel unit 5 when the driving capability (current driving capability) of the source driving unit 3 is low. Similar to FIG. 3, FIG. 5 shows the signal waveforms and noise component waveforms of the following (1) to (8), where their time axes (horizontal axes) are aligned:

(1) the output voltage V (Sn) of the positive amplifier An in a state before a current passes through the switch element SWn (the voltage V(Sn) on the source line Sn);

(2) the output voltage V(Sn+1) of the negative amplifier An+1 in a state before a current passes through the switch element SWn+1 (the voltage V(Sn+1) on the source line Sn+1);

(3) the noise component (noise current) InA (Sn) on the source line Sn in a state before a current passes through the switch element SWn;

(4) the noise component (noise current) InA (Sn+1) on the source line Sn+1 in a state before a current passes through the source element SWn+1;

(5) the combined noise component (combined noise current) InA_c (Sn, Sn+1) from the noise component on the source line Sn in a state before a current passes through the switch element SWn and the noise component on the source line Sn+1 in a state before a current passes through the switch element SWn+1;

(6) the noise component (noise current) InB(Sn) on the source line Sn in a state after a current has passed through the switch element SWn;

(7) the noise component (noise current) InB(Sn+1) on the source line Sn+1 in a state after a current has passed through the switch element SWn+1; and (8) the combined noise component (combined noise current) InB_c(Sn, Sn+1) from the noise component on the source line Sn in a state after a current has passed through the switch element SWn and the noise component on the source line Sn+1 in a state after a current has passed through the switch element SWn+1.

In FIG. 5, for ease of explanation, the noise components are exaggerated.

As will be apparent from FIG. 5, when the driving capability of the source driving unit 3 is low, that is, the output impedances (output resistances) of the positive and negative amplifiers are large, the waveform of the noise component superimposed on a current flowing in the source line Sn (the noise component occurring when the voltage V(Sn) on the source line Sn falls) remains substantially the same before and after the current passes through the switch element SWn (see the waveform of the noise component current InB(Sn) in the source line Sn). In contrast, the waveform of the noise component superimposed on a current flowing in the source line Sn+1 (the noise component occurring when the current V(Sn+1) on the source line Sn+1 rises) has a noise component in a different form after the current has passed through the switch element SWn+1, as shown in FIG. 5 (see the waveform of the noise component current InB(Sn+1) in the source line Sn+1). Thus, the noise component superimposed on a current flowing in the source line Sn+1 after the current has passed through its switch element has the waveform indicated by InB(Sn+1) of FIG. 5. The combined noise component of the noise components superimposed on currents flowing in the source lines Sn and Sn+1 has the waveform indicated by InB_c(Sn, Sn+1) of FIG. 5. As discussed with respect to the first embodiment, in the example of FIG. 5, too, the current flowing in the source line Sn after passing through its switch element is delayed by the time t1 with respect to the current flowing in the source line Sn+1.

To prevent noise superimposed on a current flowing in each of the source lines after the currents have passed through the switch elements shown in FIG. 5, the display device 1000 of the present embodiment uses the source driving unit 3 to (1) regulate the output timing of the positive amplifiers and that of the negative amplifiers in a manner similar to that of the first embodiment, and (2) regulate the output capability (driving capability) of the positive amplifiers and/or that of the negative amplifiers. This will be described with reference to FIG. 6.

Figure 6:
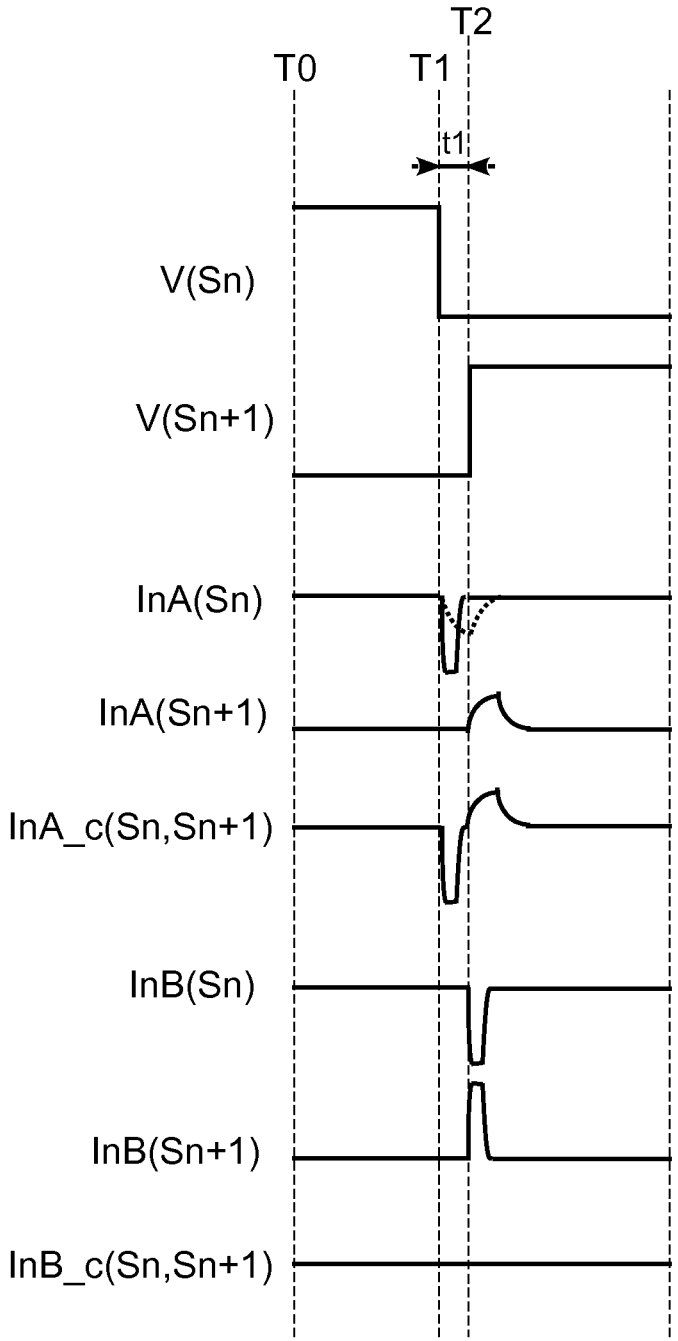
FIG. 6 schematically illustrates examples of signal waveforms and noise component waveforms in states before and after currents pass through the switch elements of the pixels of the display panel unit 5 when the source driving unit 3 performs regulation (regulates the output timing and regulates the output capability).

FIG. 6 illustrates examples of signal waveforms and noise component waveforms in a state before and after currents pass through the switch elements of the pixels of the display panel unit 5 when the source driving unit 3 of the present embodiment performs regulation (regulates the output timing and regulates the output capability).

Similar to FIG. 3, FIG. 6 shows the signal waveforms and noise component waveforms of the following (1) to (8), where their time axes (horizontal axes) are aligned:

(1) the output voltage V (Sn) of the positive amplifier An in a state before a current passes through the switch element SWn (the voltage V(Sn) on the source line Sn);

(2) the output voltage V(Sn+1) of the negative amplifier An+1 in a state before a current passes through the switch element SWn+1 (the voltage V(Sn+1) on the source line Sn+1);

(3) the noise component (noise current) InA (Sn) on the source line Sn in a state before a current passes through the switch element SWn;

(4) the noise component (noise current) InA (Sn+1) on the source line Sn+1 in a state before a current passes through the source element SWn+1;

(5) the combined noise component (combined noise current) InA_c (Sn, Sn+1) from the noise component on the source line Sn in a state before a current passes through the switch element SWn and the noise component on the source line Sn+1 in a state before a current passes through the switch element SWn+1;

(6) the noise component (noise current) InB(Sn) on the source line Sn in a state after a current has passed through the switch element SWn;

(7) the noise component (noise current) InB(Sn+1) on the source line Sn+1 in a state after a current has passed through the switch element SWn+1; and (8) the combined noise component (combined noise current) InB_c(Sn, Sn+1) from the noise component on the source line Sn in a state after a current has passed through the switch element SWn and the noise component on the source line Sn+1 in a state after a current has passed through the switch element SWn+1.

In FIG. 6, for ease of explanation, the noise components are exaggerated.

The source driving unit 3 of the present embodiment regulates its driving capability such that the noise component superimposed on the output current of the positive amplifier An (the noise component generated when the voltage V(Sn) on the source line Sn falls), after the current has passed the switch element SWn, offsets the noise component superimposed on the current flowing in the source line Sn+1 after passing through the switch element SWn+1 (the noise component generated when the voltage V(Sn+1) on the source line Sn+1 rises). More specifically, the positive amplifier regulating unit 33 reduces the output impedance (output resistance) of the positive amplifier An to set the driver capability (current driving capability) of the positive amplifier An to a higher level. Thus, the noise component generated when the output voltage of the positive amplifier An falls has the waveform indicated by InA(Sn) of FIG. 6. The noise component waveform indicated by a dotted line in the chart of InA(Sn) of FIG. 6 is a noise component waveform (noise current waveform) in a state when the positive amplifier An has a low driving capability. Furthermore, similar to the first embodiment, the source driving unit 3 of the present embodiment uses the positive and negative amplifier regulating units 33 and 34 to regulate the output timing such that the output of the negative amplifier An+1 is delayed by the time t1 with respect to the output of the positive amplifier An.

Thus, after the output timing regulation and output capability regulation are performed, the noise component InA (Sn) superimposed on a current flowing in the source line Sn and the noise component InA(Sn+1) superimposed on a current flowing in the source line Sn+1 have the signal waveforms InB(Sn) and InB(Sn+1) shown in FIG. 6 when the currents have passed through the switch elements. As indicated by InB(Sn) and InB(Sn+1) of FIG. 6, the noise component superimposed on a current flowing in the source line Sn after the current has passed through the switch element SWn and the noise component superimposed on a current flowing in the source line Sn+1 after the current has passed through the switch element SWn+1 are opposite in amplitude (in reversed phase) substantially at the same timing. This causes these noise components to be offset, resulting in no noise (see InB_c(Sn, Sn+1) of FIG. 6). Thus, even when the driving capability of the source driving unit 3 is changed (when the driving capability of the positive amplifiers and/or that of the negative amplifiers is changed), the display device of the present embodiment appropriately prevents, inside the display panel unit 5, occurrence of noise that may, for example, affect the sensor sensitivity of a capacitive touch panel placed on a display panel unit 5 and may cause a malfunction while the touch panel is operated.

Preferably, the output capability (driving capability) of the positive amplifiers and that of the negative amplifiers can be regulated separately. Further, the output capability (driving capability) of the positive amplifiers and that of the negative amplifiers are preferably regulated taking into consideration (1) the potential applied to the source of each of the switch elements connected with the outputs of the positive amplifiers, the switch resistance of theses switch elements (the resistance in a state when the switch elements are on) and the output capability (driving capability) of the positive amplifiers (the output impedance (output resistance) of the positive amplifiers), and (2) the potential applied to the source of each of the switch elements connected with the outputs of the negative amplifiers, the switch resistance of these switch elements (the resistance in a state when the switch elements are on) and the output capability (driving capability) of the negative amplifiers (the output impedance (output resistance) of the negative amplifiers).

Other Embodiments

The above embodiments describe implementations where a source line is connected with the output of each of the positive and negative amplifiers of the source driving unit 3. In other words, the above description presupposes a display device using column inversion driving, where each column is switched between positive and negative driving voltages. However, the present invention is not limited to such an arrangement. For example, the present invention may be applied to a display device using dot inversion driving, where each pixel is switched between positive and negative driving voltages, or line inversion driving, where each row is switched between positive and negative driving voltages.

A portion or the entirety of the display device of each of the above embodiments may be implemented as an integrated circuit (for example, an LSI or system LSI).

A portion or the entirety of the processing of each functional block of the above embodiments may be implemented using a program. A portion or the entirety of the processing of each functional block of the above embodiments is performed by the central processing unit (CPU) in the computer. The program for performing such processing is stored in a storage device such as a hard disk or a ROM, and may be executed from the ROM or be read into a RAM and then executed.

The processing in the above embodiment may be implemented using hardware, or may be implemented using software (which includes cases where it is implemented together with an operating system (OS), middleware or a specified library). Alternatively, the processing may be implemented using mixed processing by software and hardware.

Of course, if one of the display devices of the above embodiments is to be implemented using hardware, the timing for performing each process must be adjusted. For convenience of explanation, the above embodiments do not describe in detail the adjustments of the timing for various signals entailed when hardware is actually designed.

The steps of the processing method of each of the above embodiments are not necessarily performed in the order described in the above embodiments, and the method may be performed in a different order without departing from the spirit of the invention.

A computer program that causes a computer to perform the above method and a computer-readable recording medium that stores this program are included in the scope of the present invention. The computer-readable recording medium may be, for example, a flexible disc, hard disc, CD-ROM, MO, DVD, DVD-ROM, DVD-RAM, high-capacity DVD, next-generation DVD, or semiconductor memory.

The above computer program is not limited to those stored on the above recording medium, and may be transmitted via a telecommunication line, wireless or wire communication line, or a network such as the Internet.

The present invention is not limited to the specific arrangements of the above embodiments, and various variations and modifications are possible without departing from the spirit of the invention.

APPENDIXES

The present invention may also be represented in the following manner.

A display panel driving device of a first aspect is a display panel driving device for driving a display panel including a plurality of source lines and a plurality of gate lines and pixels each provided at the intersection of a source line and a gate line, including positive amplifiers, negative amplifiers, a positive amplifier regulating unit, a negative amplifier regulating unit, and a gate driving unit.

The positive amplifiers each transmit a positive driving signal to the display panel with via a source line.

The negative amplifiers each transmit a negative driving signal to the display panel with via a source line.

The positive amplifier regulating unit regulates timing for the positive amplifiers to output the positive driving signals.

The negative amplifier regulating unit regulates timing for the negative amplifiers to output the negative driving signals.

The gate driving unit drives and controls the display panel by supplying the display panel with gate line control signals via the gate lines.

In this display panel driving device, the positive and negative amplifier regulating units can regulate separately (independently) the timing for the positive amplifiers to output positive driving signals and the timing for the negative amplifiers to output negative driving signals. This regulates the output timing of the positive driving signals and that of the negative driving signals such that the noise components superimposed on the positive and negative driving signals are offset inside the display panel, such as a liquid crystal panel. Thus, driving the display panel using this display panel driving device effectively reduces noise generated inside the display panel, such as a liquid crystal panel.

Preferably, the source line connected with a positive amplifier and the source line connected with a negative amplifier are disposed next to each other.

A display panel driving device of a second ascend provides the display panel driving device of the first aspect in which the negative amplifier regulating unit regulates the timing for outputting the negative driving signals such that the negative driving signals are output with a delay of a predetermined time period with respect to the positive driving signals.

In this display panel driving device, the negative driving signals are output with a delay of a predetermined time period with respect to the positive driving signals; thus, setting the predetermined time period to a value that causes the noise components superimposed on the positive driving signals and the negative driving signals to be offset inside the display panel, such as a liquid crystal panel, effectively reduces noise occurring inside the display panel.

A display panel driving device of a third aspect provides the display panel driving drive of the first aspect in which the positive amplifier regulating unit regulates the timing for outputting the positive driving signals such that the positive driving signals are output a predetermined time period prior to the negative driving signals.

In this display panel driving device, the positive driving signals are output a predetermined time period prior to the negative driving signals; thus, setting the predetermined time period to a value that causes the noise components superimposed on the positive driving signals and the negative driving signals to be offset inside the display panel, such as a liquid crystal panel, effectively reduces noise occurring inside the display panel.

A display panel driving device of a fourth aspect provides the display panel driving device of the first aspect in which the positive amplifier regulating unit and the negative amplifier regulating unit regulate the timing for outputting the positive driving signals and the timing for outputting the negative driving signals, respectively, such that the negative driving signals are output with a delay of a predetermined time period with respect to the positive driving signals.

In this display panel driving device, the negative driving signals are output with a delay of a predetermined time period with respect to the positive driving signals; thus, setting the predetermined time period to a value that causes the noise components superimposed on the positive driving signals and the negative driving signals to be offset inside the display panel, such as a liquid crystal panel, effectively reduces noise occurring inside the display panel.

A display panel driving device of a fifth aspect provides the display panel driving device of one of the first to fourth aspects in which the positive amplifier regulating unit further regulates driving capability of the positive amplifiers, and the negative amplifier regulating unit further regulates driving capability of the negative amplifiers.

In this display panel driving device, the positive amplifier regulating unit and the negative amplifier regulating unit separately regulate the driving capability of the positive amplifiers and the driving capability of the negative amplifiers, respectively. Thus, this display panel driving device regulates the driving capability (current driving capability) of the positive amplifiers and/or that of the negative amplifiers such that the noise components superimposed on the positive driving signals and the negative driving signals are offset inside the display panel, such as a liquid crystal panel, even when the driving capability (current driving capability) of the positive amplifiers and/or that of the negative amplifiers is changed. As a result, this display panel driving device effectively reduces noise occurring in the display panel even when the driving capability (current driving capability) of the positive amplifiers and/or that of the negative amplifiers is changed.

Preferably, the driving capability is regulated by changing the output impedance or output resistance of the positive amplifiers and/or negative amplifiers, for example.

A display panel driving device of a sixth aspect provides the display panel driving device of the fifth aspect in which the positive amplifier regulating unit regulates the driving capability of the positive amplifiers such that noise components superimposed on the positive driving signals in a state after the positive driving signals have passed through switch elements each contained in one of the pixels of the display panel and noise components superimposed on the negative driving signals in a state after the negative driving signals have passed through switch elements each contained in one of the pixels of the display panel are offset.

This display panel driving device regulates the driving capability (current driving capability) of the positive amplifiers such that the noise components superimposed on the positive driving signals and those for the negative driving signals are offset inside the display panel, such as a liquid crystal panel. Thus, this display panel driving device effectively reduces noise occurring inside the display panel even when the driving capability (current driving capability) of the positive amplifiers and/or that of the negative amplifiers is changed.

A display panel driving device of a seventh aspect provides the display panel driving device of the sixth aspect in which the positive amplifier regulating unit regulates the driving capability of the positive amplifiers based on (1) a voltage applied to a positive amplifier side of each of the switch elements connected with outputs of the positive amplifiers, the switch resistance of these switch elements, and the driving capability of the positive amplifiers, and (2) a voltage applied to a negative amplifier side of each of the switch elements connected with outputs of the negative amplifiers, the switch resistance of these switch elements, and the driving capability of the negative amplifiers.

Thus, the driving capability of the positive amplifiers is regulated such that the noise components superimposed on the positive driving signals and those for the negative driving signals are offset inside the display panel, such as a liquid crystal panel.

A display panel driving device of a eighth aspect provides the display panel driving device of the fifth aspect in which the negative amplifier regulating unit regulates the driving capability of the negative amplifiers such that noise components superimposed on the positive driving signals in a state after the positive driving signals have passed switch elements each contained in one of the pixels of the display panel and noise components superimposed on the negative driving signals in a state after the negative driving signals have passed through switch elements each contained in one of the pixels of the display panel are offset.

This display panel driving device regulates the driving capability (current driving capability) of the negative amplifiers such that the noise components superimposed on the positive driving signals and those for the negative driving signals are offset inside the display panel, such as a liquid crystal panel. Thus, this display panel driving device effectively reduces noise occurring inside the display panel even when the driving capability (current driving capability) of the positive amplifiers and/or that of the negative amplifiers is changed.

A display panel driving device of a ninth aspect provides the display panel driving device of the eighth aspect in which the negative amplifier regulating unit regulates the driving capability of the negative amplifiers based on (1) a voltage applied to a positive amplifier side of each of the switch elements connected with outputs of the positive amplifiers, the switch resistance of these switch elements, and the driving capability of the positive amplifiers, and (2) a voltage applied to a negative amplifier side of each of the switch elements connected with outputs of the negative amplifiers, the switch resistance of these switch elements, and the driving capability of the negative amplifiers.

Thus, the driving capability of the negative amplifiers is regulated such that the noise components superimposed on the positive driving signals and those for the negative driving signals are offset inside the display panel, such as a liquid crystal panel.

A display device of a tenth aspect is a display device including the display panel driving device of one of the first to ninth aspects.

Thus, a display device using the display panel driving device of one of the first to ninth aspects is implemented.

INDUSTRIAL APPLICABILITY

The display panel driving device and display device according to the present invention effectively reduces noise occurring inside the display panel, and thus are useful in the industrial field of display devices and may be implemented in this field.

EXPLANATION OF REFERENCE CHARACTERS

1000 display device
1 signal processing unit
2 timing control unit
3 source driving unit
4 gate driving unit
5 display panel unit
31 data processing unit
32 setting holding unit
33 positive amplifier regulating unit
34 negative amplifier regulating unit
A1, A3, . . . , An positive amplifiers
A2, A4, . . . , An+1 negative amplifiers
SW1-Swn+1 switch elements
LC1-LCn+1 display elements (liquid crystal elements)

The invention claimed is:

1. A display panel driving device for driving a display panel including a plurality of source lines and a plurality of gate lines and pixels each provided at the intersection of a source line and a gate line, comprising:

positive amplifiers each configured to transmit a positive driving signal to the display panel via a source line;

negative amplifiers each configured to transmit a negative driving signal to the display panel with via a source line;

a positive amplifier regulating unit configured to regulate timing for the positive amplifiers to output the positive driving signals;

a negative amplifier regulating unit configured to regulate timing for the negative amplifiers to output the negative driving signals; and a gate driving unit configured to drive and control the display panel by supplying the display panel with gate line control signals via the gate lines, wherein, the positive amplifier regulating unit further regulates driving capability of the positive amplifiers;

the negative amplifier regulating unit further regulates driving capability of the negative amplifiers; and the positive amplifier regulating unit further regulates driving capability of the positive amplifiers such that noise components superimposed on the positive driving signals in a state after the positive driving signals have passed through switch elements each contained in the display panel and noise components superimposed on the negative driving signals in a state after the negative driving signals have passed through switch elements each contained in the display panel are offset.

2. The display panel driving device according to claim 1, wherein the positive amplifier regulating unit regulates the driving capability of the positive amplifiers based on (1) a voltage applied to a positive amplifier side of each of the switch elements connected with outputs of the positive amplifiers, the switch resistance of these switch elements, and the driving capability of the positive amplifiers, and (2) a voltage applied to a negative amplifier side of each of the switch elements connected with outputs of the negative amplifiers, the switch resistance of these switch elements, and the driving capability of the negative amplifiers.

3. A display device comprising the display panel driving device according to claim 1.

4. The display panel driving device according to claim 1, wherein the negative amplifier regulating unit regulates the timing for outputting the negative driving signals such that the negative driving signals are output with a delay of a predetermined time period with respect to the positive driving signals.

5. The display panel driving device according to claim 1, wherein the positive amplifier regulating unit regulates the timing for outputting the positive driving signals such that the positive driving signals are output a predetermined time period prior to the negative driving signals.

6. The display panel driving device according to claim 1, wherein the positive amplifier regulating unit and the negative amplifier regulating unit regulate the timing for outputting the positive driving signals and the timing for outputting the negative driving signals, respectively, such that the negative driving signals are output with a delay of a predetermined time period with respect to the positive driving signals.

7. The display panel driving device according to claim 1, wherein two of the source lines connected with the positive amplifier and the negative amplifier respectively are disposed next to each other.

8. A display panel driving device for driving a display panel including a plurality of source lines and a plurality of gate lines and pixels each provided at the intersection of a source line and a gate line, comprising:

positive amplifiers each configured to transmit a positive driving signal to the display panel via a source line;

negative amplifiers each configured to transmit a negative driving signal to the display panel via a source line;

a positive amplifier regulating unit configured to regulate timing for the positive amplifiers to output the positive driving signals;

a negative amplifier regulating unit configured to regulate timing for the negative amplifiers to output the negative driving signals; and a gate driving unit configured to drive and control the display panel by supplying the display panel with gate line control signals via the gate lines, wherein the positive amplifier regulating unit further regulates driving capability of the positive amplifiers;

the negative amplifier regulating unit further regulates driving capability of the negative amplifiers; and the negative amplifier regulating unit regulates the driving capability of the negative amplifiers such that noise components superimposed on the positive driving signals in a state after the positive driving signals have passed switch elements each contained in the display panel and noise components superimposed on the negative driving signals in a state after the negative driving signals have passed through switch elements each contained in the display panel are offset.

9. The display panel driving device according to claim 8, wherein the negative amplifier regulating unit regulates the driving capability of the negative amplifiers based on (1) a voltage applied to a positive amplifier side of each of the switch elements connected with outputs of the positive amplifiers, the switch resistance of these switch elements, and the driving capability of the positive amplifiers, and (2) a voltage applied to a negative amplifier side of each of the switch elements connected with outputs of the negative amplifiers, the switch resistance of these switch elements, and the driving capability of the negative amplifiers.

10. The display panel driving device according to claim 8, wherein the negative amplifier regulating unit regulates the timing for outputting the negative driving signals such that the negative driving signals are output with a delay of a predetermined time period with respect to the positive driving signals.

11. The display panel driving device according to claim 8, wherein the positive amplifier regulating unit regulates the timing for outputting the positive driving signals such that the positive driving signals are output a predetermined time period prior to the negative driving signals.

12. The display panel driving device according to claim 8, wherein the positive amplifier regulating unit and the negative amplifier regulating unit regulate the timing for outputting the positive driving signals and the timing for outputting the negative driving signals, respectively, such that the negative driving signals are output with a delay of a predetermined time period with respect to the positive driving signals.

13. A display device comprising the display panel driving device according to claim 8.

14. The display panel driving device according to claim 8, wherein two of the source lines connected with the positive amplifier and the negative amplifier respectively are disposed next to each other.

* * * * *